US006336953B1

(12) United States Patent
Kikukawa et al.

(10) Patent No.: US 6,336,953 B1
(45) Date of Patent: Jan. 8, 2002

(54) METHOD FOR PREPARING METAL POWDER

(75) Inventors: Masato Kikukawa, Otsu; Shigemasa Matsunaga, Kyoto; Tsuneta Inaba, Otsu; Osamu Iwatsu, Kobe; Tohru Takeda, Yamato, all of (JP)

(73) Assignee: Fukuda Metal Foil & Powder Co., Ltd., Kyoto (JP)

( * ) Notice: Subject to any disclaimer, the term of this patent is extended or adjusted under 35 U.S.C. 154(b) by 0 days.

(21) Appl. No.: 09/509,592

(22) PCT Filed: Jun. 23, 1999

(86) PCT No.: PCT/JP99/03338

§ 371 Date: Mar. 30, 2000

§ 102(e) Date: Mar. 30, 2000

(87) PCT Pub. No.: WO00/38865

PCT Pub. Date: Jul. 6, 2000

(30) Foreign Application Priority Data

Dec. 24, 1998 (JP) ..... PCT/JP98/05867

(51) Int. Cl.[7] ..... B22F 9/08
(52) U.S. Cl. ..... 75/341; 75/331
(58) Field of Search ..... 75/331, 333, 337, 75/341

(56) References Cited

FOREIGN PATENT DOCUMENTS

| | | | |
|---|---|---|---|
| JP | 63050404 A | * | 3/1988 |
| JP | 01123012 A | * | 5/1989 |
| JP | 02198620 A | * | 8/1990 |
| JP | 04083813 A | * | 3/1992 |
| JP | 04276006 A | * | 10/1992 |
| JP | 08013007 A | * | 1/1996 |

* cited by examiner

*Primary Examiner*—Roy King
*Assistant Examiner*—Harry S. Wilkins, III
(74) *Attorney, Agent, or Firm*—Armstrong, Westerman, Hattori, McLeland & Naughton LLP

(57) ABSTRACT

The present invention relates to a method for preparing metal powder by means of blowing a cooling liquid toward a flowing down melt metal flow characterized that the cooling liquid is successively discharged downwardly from an annular nozzle toward the melt metal flow for surrounding it in the form of a hyperboloid of one sheet, wherein the annular nozzle is provided with a hole through which the melt metal flow may pass, and that the hyperboloid of one sheet has a pressure reduced by 50~750 mmHg at the neighborhood of the constricted part inside the hyperboloid of one sheet. According to the present invention, there may be prepared fine and sherical metal powder which has a narrow range of a particle size distribution.

11 Claims, 12 Drawing Sheets

METHOD FOR PREPARING METAL POWDER

TECHNICAL FIELD

The present invention relates to a method for preparing metal powder, and in detail to a method for preparing fine and spherical metal powder having a narrow particle size distribution.

BACKGROUND ART

There have been several methods for preparing metal powder, one of which is known as an atomizing method that is a way accompanied with a cooling medium (or an atomizing medium) blowing to a melt metal flow to efficiently prepare metal powder. The atomizing method is generally classified into a gas atomizing method using a gas cooling medium and a liquid atomizing method using a liquid cooling medium.

As an example of gas atomizing method, a method has been known to utilize a nozzle disclosed in U.S. Pat. No. 1,659,291 and U.S. Pat. No. 3,235,783. While gas jet discharged from the nozzle according to the gas atomizing method can not be watched, observation by Schlieren photography can support that it flows to expand monotonously. It is considered that gas jet is a compressible fluid to adiabatically expand just after discharged from the nozzle. Since an adiabatic expansion makes the energy density of the gas jet decrease suddenly, it is difficult to efficiently obtain fine metal powder by means of the gas atomizing method. Thusly prepared metal powder has a broad particle size distribution. Also, the gas atomizing method is accompanied with another problem that the atmosphere may engulf the gas jet to blow up the melt metal.

The gas used as a cooling medium however has a relatively small cooling ability so that the melt metal drop dispersed by the gas jet may make solidification after changing itself into a spherical shape. Therefore the metal powder prepared according to the gas atomizing method has a generally spherical shape.

The nozzle disclosed in above-mentioned U.S. Pat. No. 1,659,291 and U.S. Pat. No. 3,235,783 is provided with gas inlets in the tangential direction of the nozzle and blades inside the nozzle to direct the discharged gas jet into the direction similarly inclined with respect to the center of the nozzle. It is considered that this inclined direction prevents the atmosphere from engulfing the gas jet so that the melt metal may not be blown up.

On the other hand, There have been known such liquid atomizing methods as V-jet type liquid atomizing method (shown in FIG. 11(*a*) or FIG. 11(*b*)) characterized in that the liquid jet converges in a line, conical jet type liquid atomizing method (shown in FIG. 11(*c*)) characterized in that liquid jet converges in one point, or pencil jet type liquid atomizing method (shown in FIG. 11(*d*)) characterized in that the liquid jet discharged from pencil jet type nozzle parts 14 converges in one point.

Since the cooling medium used in a liquid atomizing method is an incompressible fluid, the energy density of the liquid jet for dispersing the melt metal flow 6 is much larger than that of a gas jet. Therefore, the liquid atomized metal powder is finer than the gas atomized metal powder.

However, prior art liquid atomizing methods are accompanied with a problem that the liquid jet converges or collides in a line or in one point. Thus, the dispersed melt metal drops before solidification have to concentrate to the vicinity of the focus and cross the liquid jet violently to thereby be cooled suddenly. Therefore, the dispersed melt metal drops contact and adhere to each other in the form of cluster so that the obtained metal powder has an irregular shape and a broad particle size distribution including coarse metal powder.

Thus, if demanding metal powder having a spherical shape and a narrow particle size distribution, another separation or mechanical treatment must be added which thereby raises its preparation cost.

There have been several improvements to solve the above-mentioned problems in the liquid atomizing method.

One of the improvements is that V-jet or conical jet converges while having a focus of a smaller vertical angle to thereby decrease the collision energy of the liquid jet so as to decrease the deformation of the dispersed metal drops. However actually obtained metal powder does not have a spherical shape. And since this improvement makes the distance between the nozzle and the focus longer, larger energy loss occurs so that the obtained metal powder may include coarse metal powder having a broader particle size distribution.

Several improvements for conical jet type liquid atomizing method are disclosed in Japanese patent No. 552,253 (Japanese Patent Publication No. 43-6,389), Japanese Patent Publication No. 3-55,522 and Japanese Patent Publication No. 2-56,403. According to the invention disclosed in Japanese Patent Publication No. 2-56,403, a cooling medium is introduced in the tangential and the normal direction of the nozzle for discharging the liquid jets. If the liquid jet discharged has a condition of making a hole, only a coarse metal powder is prepared.

Another improvement is disclosed in Japanese Patent Publication No. 53-16,390, which is provided with an exhaust pipe in the under surface for making the liquid jet turbulent to promote the efficiency for dispersing the melt metal flow. According to the improvement, the melt metal flow contacts violently with the turbulent liquid jet to prepare fine metal powder, which is however not spherical shaped.

An annular nozzle of swirling type is disclosed in Japanese laid open patent publication No. 1-123012, which discharges a cooling medium surrounding the melt metal flow in the form of a hyperboloid of one sheet. The liquid jet is discharged from the annular nozzle for dispersing to successively shave off the circumference of the melt metal flow passing through the constricted part of the hyperboloid of one sheet. Thus, this nozzle prevents dispersed melt metal drops from adhering to each other to thereby prepare fine and spherical metal powder. However since the efficiency for dispersing the melt metal flow is very low, a part of the melt metal flow is not dispersed to pass through the constricted part of the hyperboloid of one sheet so as to generate a coarse metal powder. Therefore, metal powder having a narrow particle size distribution can not be actually prepared by the annular nozzle disclosed in Japanese laid open patent publication No. 1-123,012.

The object of the Invention

This invention provides a technique for efficiently preparing finer and more spherical metal powder having a narrower particle size distribution than that of prior art liquid atomizing method.

Solution

Present inventors have considered various alternatives in order to overcome above problems and have accomplished the present inventions. There is provided a method for preparing metal powder by means of blowing a cooling liquid toward a flowing down melt metal flow characterized that the cooling liquid is successively discharged downwardly from an annular nozzle toward the melt metal flow for surrounding it in the form of a hyperboloid of one sheet, wherein the annular nozzle is provided with a hole through which the melt metal flow may pass, and that the hyperboloid of one sheet has a pressure reduced by 50~750 mmHg at the neighborhood of the constricted part inside the hyperboloid of one sheet.

Thus, above mentioned problems are overcome by discharging liquid jet toward a flowing down melt metal flow in the form of a hyperboloid of one sheet and generating a remarkably large pressure difference inside the hyperboloid of one sheet. There are several ways to reduce the pressure inside the hyperboloid of one sheet. For example, it may be reduced by disposing an exhaust pipe at the lower part of the annular nozzle described hereinafter, using a chamber having a relatively small inner volume, or disposing a preferable exhaust apparatus at a chamber.

Followings are detail descriptions about the present inventions.

BRIEF DESCRIPTION OF THE FIGURES

FIG. 1 shows an embodiment of an annular nozzle 1 using the present method for preparing metal powder, in particular (a) shows a cross sectional view and (b) shows a longitudinal sectional view on the y axis in the (a). The annular nozzle 1 shown in FIG. 1 is disposed at an apparatus for preparing metal powder so that flowing down melt metal flow 6 may pass through the hole 2 formed in the annular nozzle.

Figure 1:
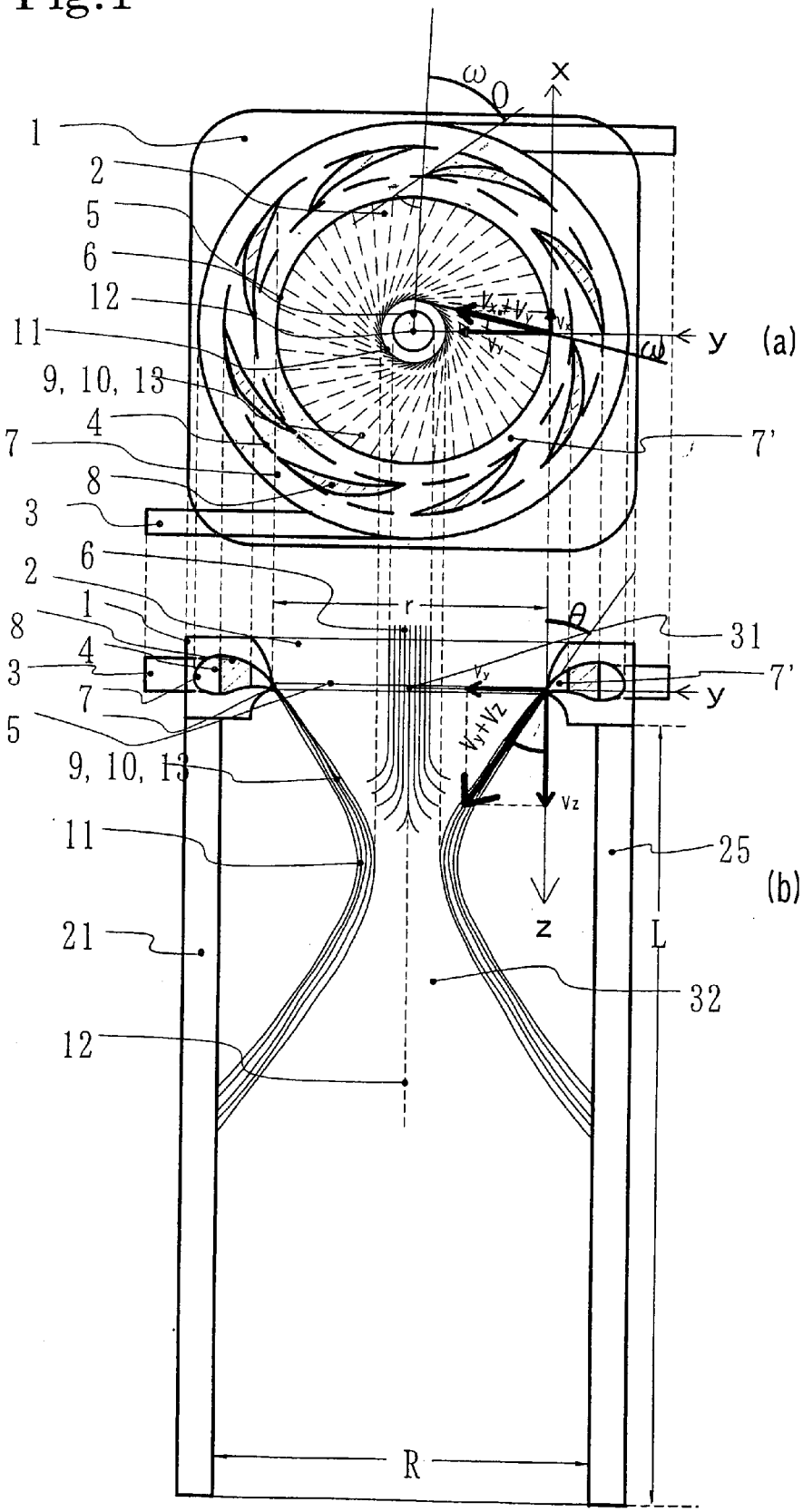
FIG. 1 is a cross sectional view (a) and a longitudinal sectional view (b) showing an operating annular nozzle disposed at the present apparatus for preparing metal powder.

This annular nozzle 1 has inlets 3, a swirling room 4, an annular slit 5 and an exhaust pipe 21. A cooling liquid is introduced from the inlet 3 to be swirled in the swirling room 4 for being discharged from the annular slit 5 toward the melt metal flow passing through the hole 2. Next is a further detail description about this annular nozzle 1.

The inlet 3 is provided in the tangential direction of the swirling room 4 in the annular nozzle so that the cooling liquid may be introduced into the swirling room 4 at a high pressure and the introduced cooling liquid may be swirled in the swirling room 4. While it is sufficient that at least one inlet is provided on the present annular nozzle, two inlets are provided on this embodiment nozzle to introduce the cooling liquid at a higher pressure. The inlet also need not be provided in the tangential direction of the swirling room, but may be formed in normal direction of the swirling room.

The swirling room 4 is formed for surrounding the circumference of the hole 2 of the annular nozzle 1. Thus, the cooling liquid is introduced into the swirling room 4 to be swirled around the melt metal flow passing through the hole 2 before discharged. The swirling room 4 has a cavity space 7 having no obstruction on the outer periphery of the room 4 so that the cooling liquid introduced from the inlet may spread generally in the swirling room. Therefore the cooling liquid may be introduced into the annular nozzle at a high pressure. The provision of the cavity 7 may be omitted if two and more inlets 3 are provided on the nozzle in the tangential direction of it.

Several blades 8 are provided inside the cavity 7 of the swirling room 4. The blades 8 may serve to stabilize the flow of the cooling liquid so that the cooling liquid may be led more inwardly with swirling. The cooling liquid is then discharged at a generally constant pressure from any point of the annular slit 5 (which has a diameter of 20 mm) formed along the inner surface of the hole 2. An angle between the radius direction of the nozzle and the tangential direction of the outer side of the top of the blade 8 is $3° \leqq \omega_{0,} \leqq 90°$, especially $5° \leqq \omega_{0,} \leqq 90°$, more especially $7° \leqq \omega_{0,} \leqq 90°$ so that the liquid jet may be discharged having a preferable range of the swirling angles described hereinafter.

Also, in addition to or instead of above blades, another path or channel may be provided for swirling the cooling liquid in the swirling room, which may be revolved by a rotation and so on.

The cooling liquid obtains a swirling power in the swirling room 4 to be led to the annular slit 5 with fin-tiler swirling in the cavity space 7' located inside the blades. The cavity space 7' inside the swirling room 4 becomes narrower and narrower toward the annular slit 5. The cooling liquid thereby may be discharged from the annular slit 5 at a flow speed of 100 m/sec or more, especially 130 m/sec or more, more especially 150 m/sec or more, and most especially 200 m/sec or more. The speed of the liquid jet may be calculated by means of Bernoulli's theorem using a pressure of the introduced cooling liquid which is measured at inlet 3.

While the liquid jet has to be discharged toward the melt metal flow after passing through the hole 2, the annular slit is not limited to be positioned at the inner surface of the hole, but may be positioned at the under surface of the annular nozzle 1. According to the present invention, the form of the annular slit is not limited to be circular as shown in the appended figures, but may be ellipsoidal, rectangular and so on.

Figure 2:
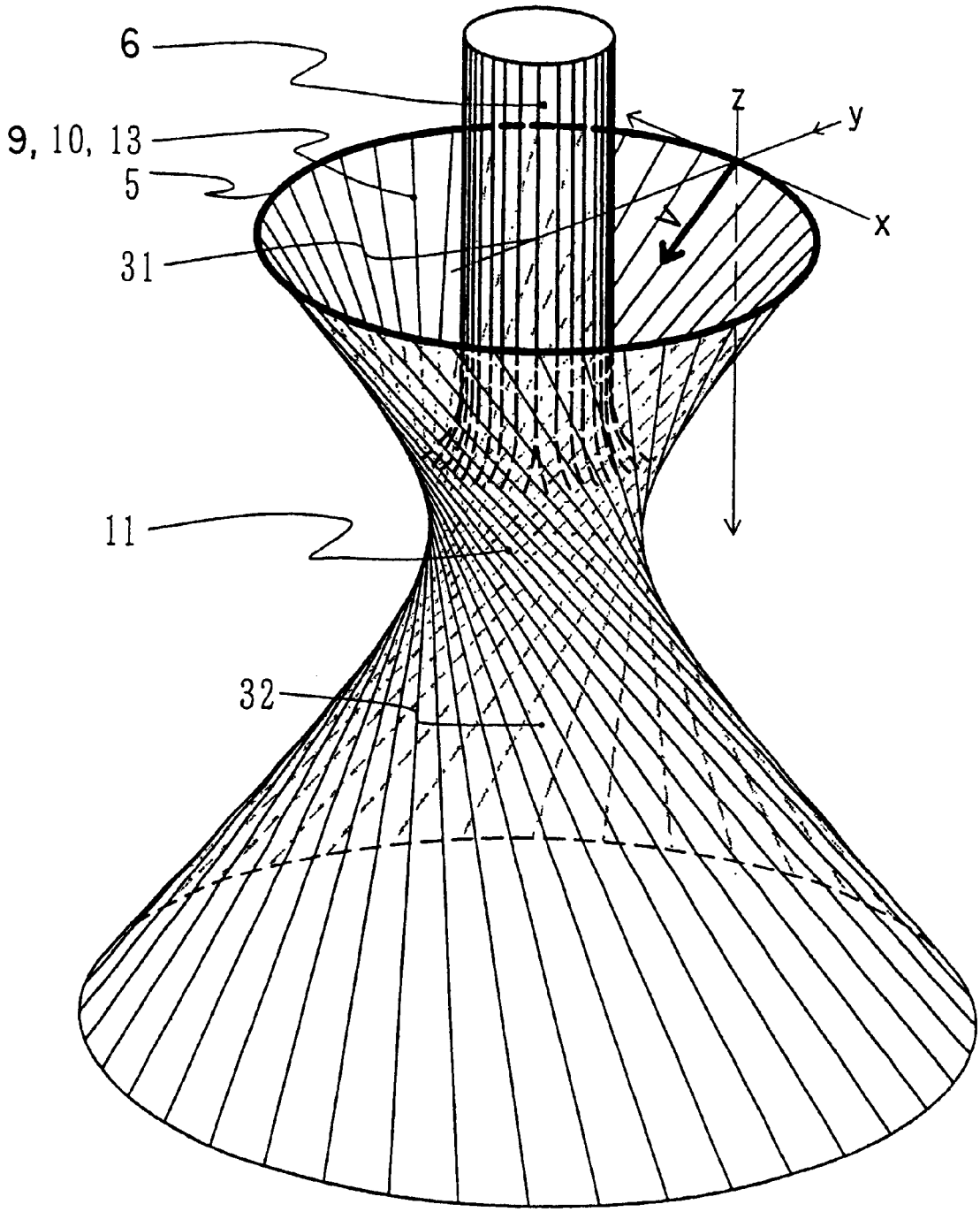
FIG. 2 is a perspective view illustrating the liquid jet discharged from the annular nozzle shown in FIG. 1 in the form of hyperboloid of one sheet.

The liquid jet 13 discharged from the annular nozzle 1 may make a form of hyperboloid of one sheet 9 illustrated in FIG. 2. The hyperboloid of one sheet shown in FIG. 1 and FIG. 2 has several flow lines 10 indicating the directions of the liquid jet discharged from any points of the annular slit 5. According to the present invention, the liquid jet 13 (or each of the flow lines 10) discharged from any points of the annular slit 5 may flow to form a constricted part 11, so that it flows first to be convergent without collision and then to be divergent. The constricted part of the hyperboloid of one sheet may not be sometimes watched, particularly if the liquid jet flows with a turbulence or at a smaller swirling angle ω of the range described hereinafter. It is apparent that the preferable effect according to the present invention can be obtained when the flow line which is read from the liquid jet has a swirling angle of 1° and more.

The liquid jet can be preferably discharged from the present annular nozzle with the swirling angleω and the descending angle θ defined as follows.

The velocity V of the liquid jet may be considered to be divided into a velocity component $V_x$ in the tangential direction of the annular slit (in the direction of the x axis in FIG. 2), a velocity component $V_y$ in the normal direction of the annular slit (in the direction of the y axis in FIG. 2), and a velocity component $V_z$ in the vertical direction (in the direction of z axis in FIG. 2). Then the swirling angleω is defined to be an angle between the y axis and the direction of the resultant force of the $V_x$ and the $V_y$. The descending angle θ is also defined to be an angle between the z axis and the direction of the resultant force of the $V_y$ and the $V_z$.

It is preferable that the liquid jet has a swirling angleω of $1° \leqq \omega \leqq 20°$, especially $2° \leqq \omega \leqq 15°$, most especially $3° \leqq \omega \leqq 10°$, and a descending angle θ of $5° \leqq \omega \leqq 60°$, especially $7° \leqq \omega \leqq 55°$, most especially $8° \leqq \omega \leqq 40°$. The liquid jet discharged at above ranges of the swirling angleω and the descending angle θ may produce particularly good metal powder.

This annular nozzle is provided with an exhaust pipe 21 having a generally similar inner diameter at any points of it and extending downwardly from the under surface of the annular nozzle as shown in FIG. 1(*b*). It is preferable that a coating such as full hard metal or ceramics is provided on the inside wall of the exhaust pipe to prevent it from being abraded. This exhaust pipe 21 is disposed at the annular nozzle so that the central axis of the annular nozzle is consonant with the central axis of the exhaust pipe so that the liquid jet may be discharged from the annular slit 5 for forming a hyperboloid of one sheet in the exhaust pipe 21. Thus a remarkable large pressure difference may occur inside the hyperboloid of one sheet.

Figure 5:
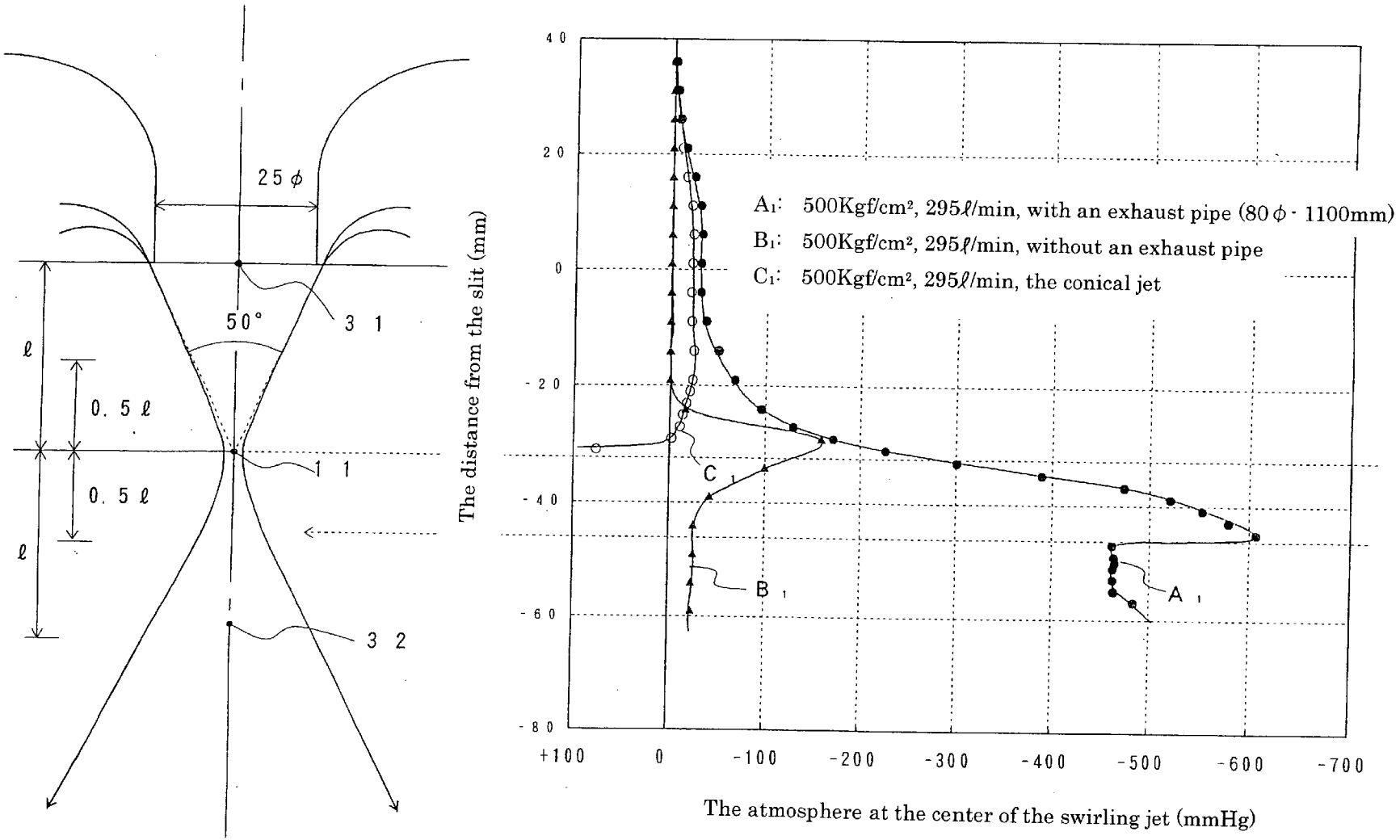
FIGS. 5 to 7 are views showing comparison of the pressure variations generated inside the hyperboloid of one sheet or the conical discharged from various type of nozzles.

According to the present invention, the length from the top edge to the constricted part of the hyperboloid of one sheet is defined to be "l", the range of 0.5 l up and down from the center of the constricted part inside the hyperboloid of one sheet is referred to as "the neighborhood of the constricted part of the hyperboloid of one sheet", and the pressure near the entrance of the hole of the annular nozzle is referred to as "the pressure of the liquid atomizing atmosphere" (ref. FIG. 5). The neighborhood of the constricted part of the hyperboloid of one sheet may have a smaller pressure by 50~750 mmHg, especially 100~750 mmHg, more especially 150~700 mmHg, most especially 200~700 mmHg than the pressure of the liquid atomizing atmosphere. Further, the neighborhood of the top of the hyperboloid of one sheet, that is strictly in the range of 0.5 l up and down from the top edge of the hyperboloid of one sheet, preferably has a lower pressure by 10~100 mmHg than the pressure of the liquid atomizing atmosphere. Also, the lower part of the constricted part, that is strictly under "the neighborhood of the constricted part of the hyperboloid of one sheet", preferably has a lower pressure by 50~700 mmHg than the pressure of the liquid atomizing atmosphere. Such a large pressure difference inside the hyperboloid of one sheet may enhance the efficiency for dispersing the melt metal flow so as to prevent it from passing through the constricted part without being dispersed.

The size of the exhaust pipe disposed at the present annular nozzle is not limited. However, when the length of the exhaust pipe 21 is defined to be "L", the inner diameter of the exhaust pipe is defined to be "R", and the diameter of the annular slit 5 is defined to be "r", the exhaust pipe preferably may have a length L of 3~100 r, especially 5~50 r, and a inner diameter R of 1.5~5 r, especially 2~4 r.

Figure 3:
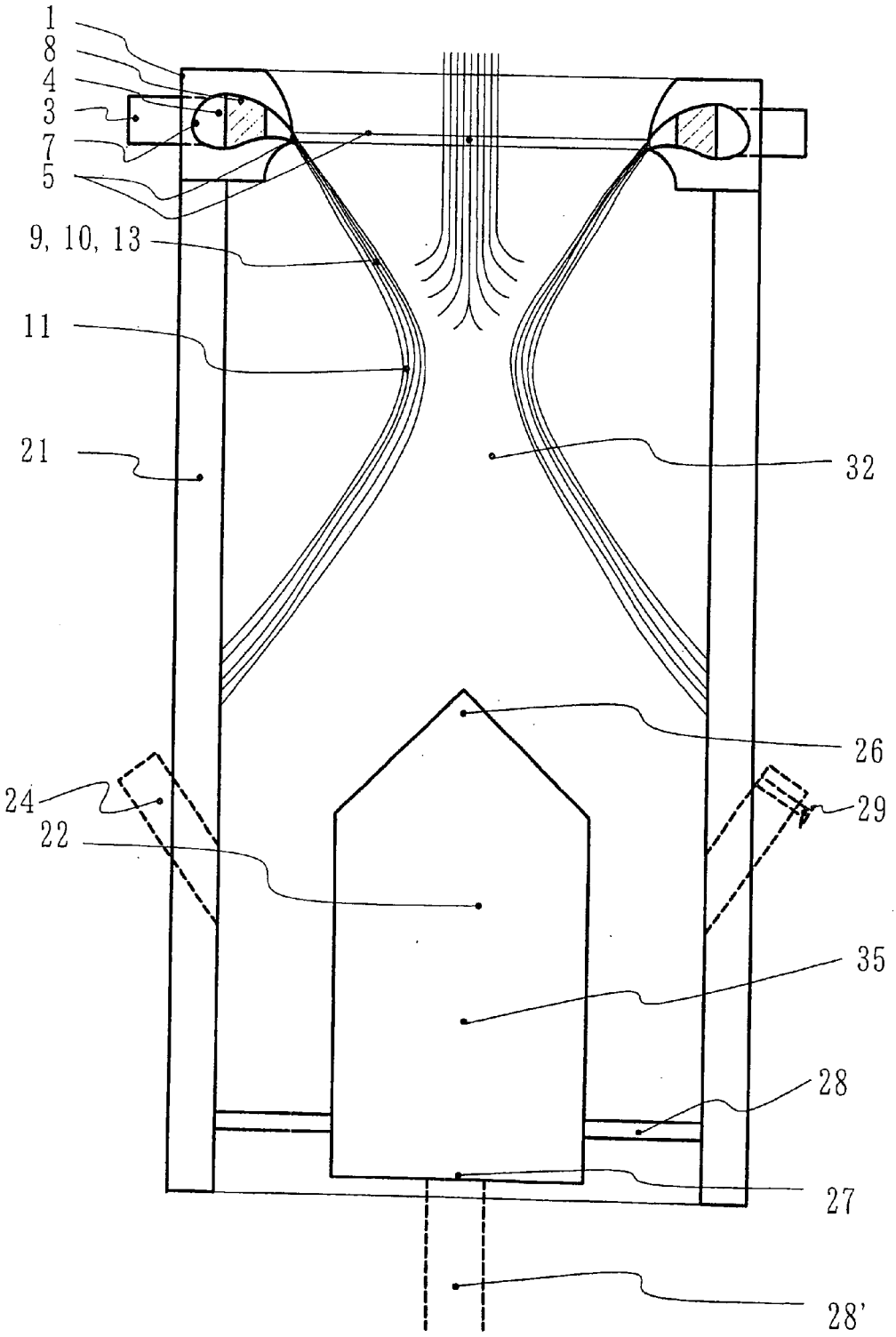
FIG. 3 is a view showing another embodiment of the present annular nozzle.

As shown in FIG. 3, the exhaust pipe is provided with a rectification body 22 having a trunk 35 with a larger diameter than that of the constricted part 11, which is disposed so that the upper part 26 of the trunk is positioned along the inside of the lower part of the hyperboloid of one sheet. The rectification body 22 prevents the liquid jet from colliding with the inner wall of the exhaust pipe so that the liquid jet may not become turbulent into flowing up. The rectification body 22 serves to decrease the sectional area in the lower part of the exhaust pipe to further reduce the pressure at the constricted part 11 of the hyperboloid of one sheet or the lower 32. The rectification body 22 has various shapes such as pillar, cylinder, conicalness or truncated cone, which is disposed inside the exhaust pipe 21 by a fixer 28 extending inward in the radius direction of the exhaust pipe from its inner wall. Also, it may be fixed by a holder 28' extending from the outside of the exhaust pipe.

The exhaust pipe having above rectification pipe may have same length as that of the exhaust pipe not having the rectification body, although may have a length of 3~30 r, especially 5~20 r.

As shown by dashed lines in FIG. 3, the exhaust pipe may further be provided with a gas inlet pipe 24 with a valve 29 for adjusting the pressure inside the exhaust pipe. This gas inlet pipe 24 can make gas (or atmosphere) spontaneously induce into the exhaust pipe in accordance with the flow of the liquid jet so as to control the pressure or the flow condition of the liquid jet in the exhaust pipe to thereby prevent the exhaust pipe from being abraded or adhering to melt metal drops. The introduction of the gas into the exhaust pipe may be controlled by opening and shutting the valve as well as by a size, a disposed direction and a disposed position of the gas inlet pipe. An air blower may also be provided at the gas inlet pipe to compulsory inject air into the exhaust pipe so as to further reduce the pressure in the exhaust pipe.

Figure 4:
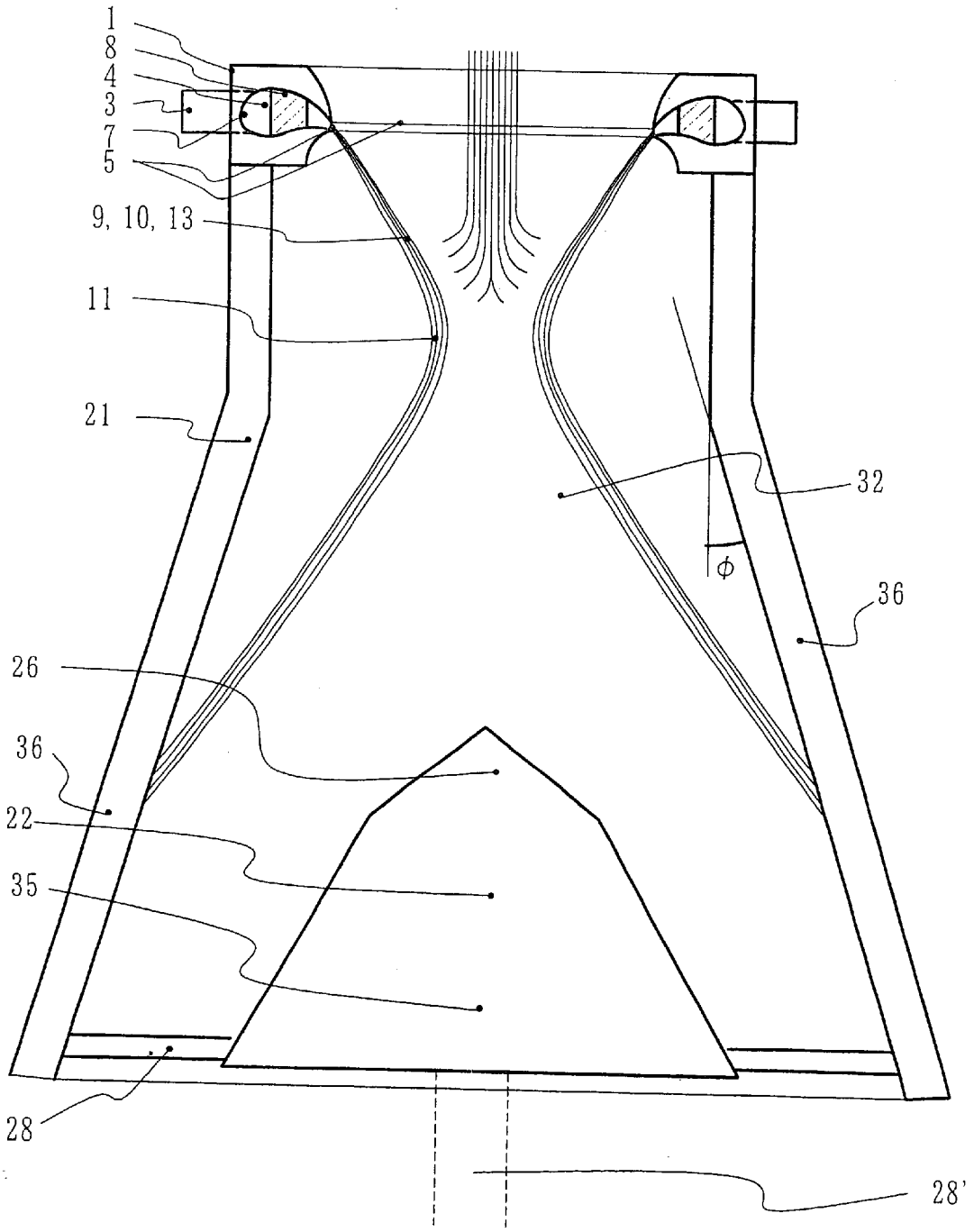
FIG. 4 is a view showing another embodiment of the present annular nozzle.

The inner diameter of the exhaust pipe 21 is not limited to be similar at any points thereof. As shown in FIG. 4, the exhaust pipe may have an inclined section part 36 having a longitudinal section going through the central axis of the exhaust pipe, which extends downwardly to be distant from the central axis. The inclined section part alleviates or prevents the collision of the liquid jet with the inner wall of the exhaust pipe so that the obtained metal powder may have a smaller deformation and the damage to the inner wall of the exhaust pipe is also alleviated.

As shown in FIG. 4, it is preferable that the inclined section part 36 has an angle ϕ of $5° \leqq \phi \leqq 60°$ against the vertical direction, and this angle ϕ is preferably set to be smaller by 5~20° than the above mentioned descending angle ϕ.

Also the use of the exhaust pipe with the inclined section part is preferably accompanied with further disposal of the rectification body 22 described before. Such an exhaust pipe with the rectification body may have the same length as that of the exhaust pipe without a rectification body, although preferably may have a length of 3~30 r, especially 5~20 r.

Figure 12:
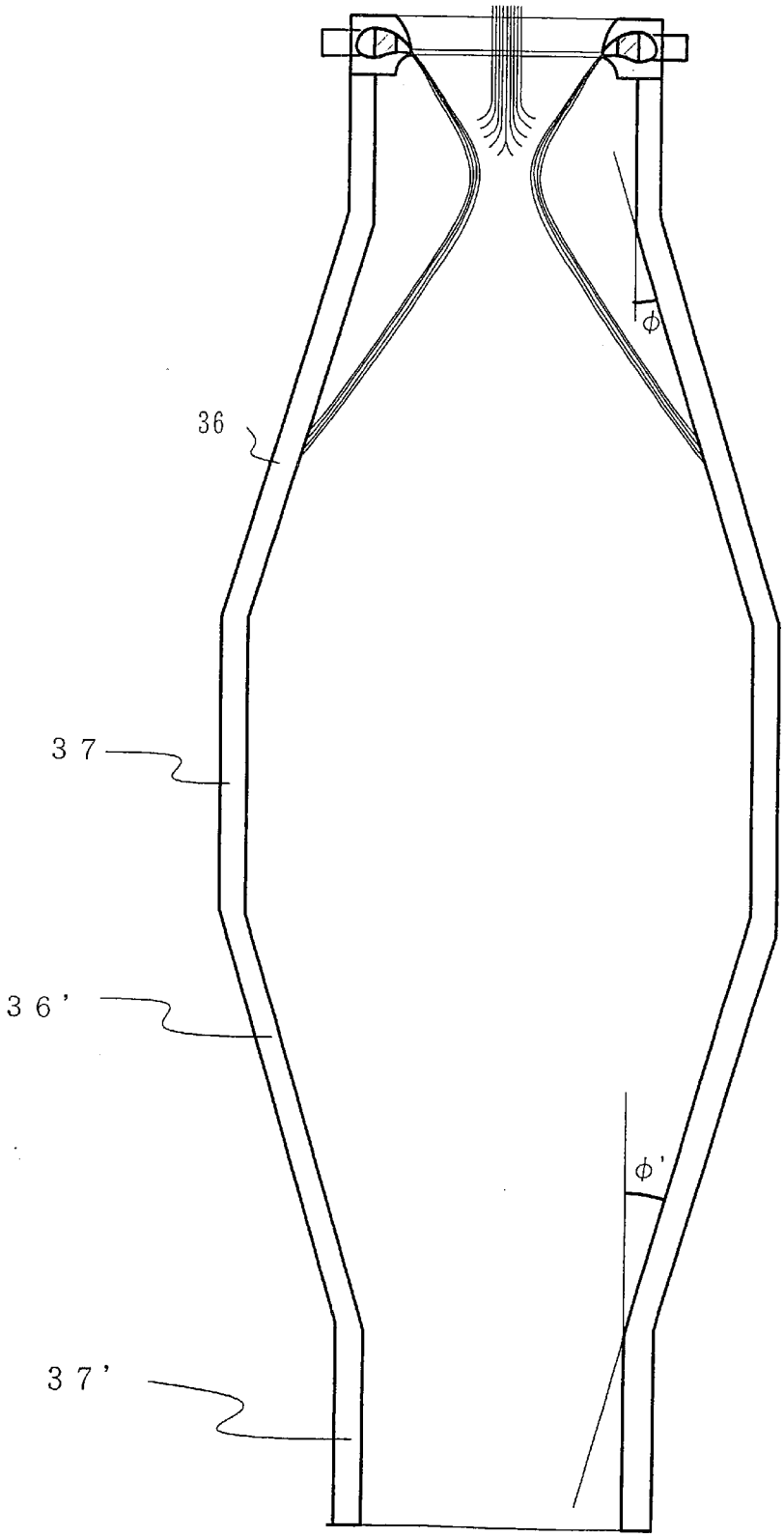
FIG. 12 is a view showing another embodiment of an annular nozzle according to the present invention.

Instead of providing the exhaust pipe with an inclined section part 36 as described above, an exhaust pipe with several inclined sections may be used as shown in FIG. 12, which has a longitudinal section going through the central axis of the exhaust pipe, comprising a first inclined section part 36 extending downwardly for being distant from the central axis, a first vertical section part 37 extending vertically from the lower end of the first inclined section part 36, a second inclined section part 36' extending downwardly from the lower end of the first vertical section part 37 for approaching to the central axis, and a second vertical section part 37' extending vertically from the lower end of the second inclined section part 36'. Therefore, the exhaust pipe with above mentioned several inclined sections extending downwardly has various inner diameters to be first expanded and then reduced gradually. The exhaust pipe with the several inclined sections may omit the provision of the rectification body. An angle f' formed between the inclined section part 36' and the vertical direction may be different from above mentioned angle f, although preferably may be similar to it.

While water may be discharged from the annular nozzle at various volume, it is preferable that the ratio of "the volume of the melt metal flown at an unit time" to "the volume of cooling liquid discharged at an unit time" is 1:2~100, more especially 1:3~50, most especially 1:5~30. Thus, good metal powder may be prepared efficiently and inexpensively.

Figure 11:
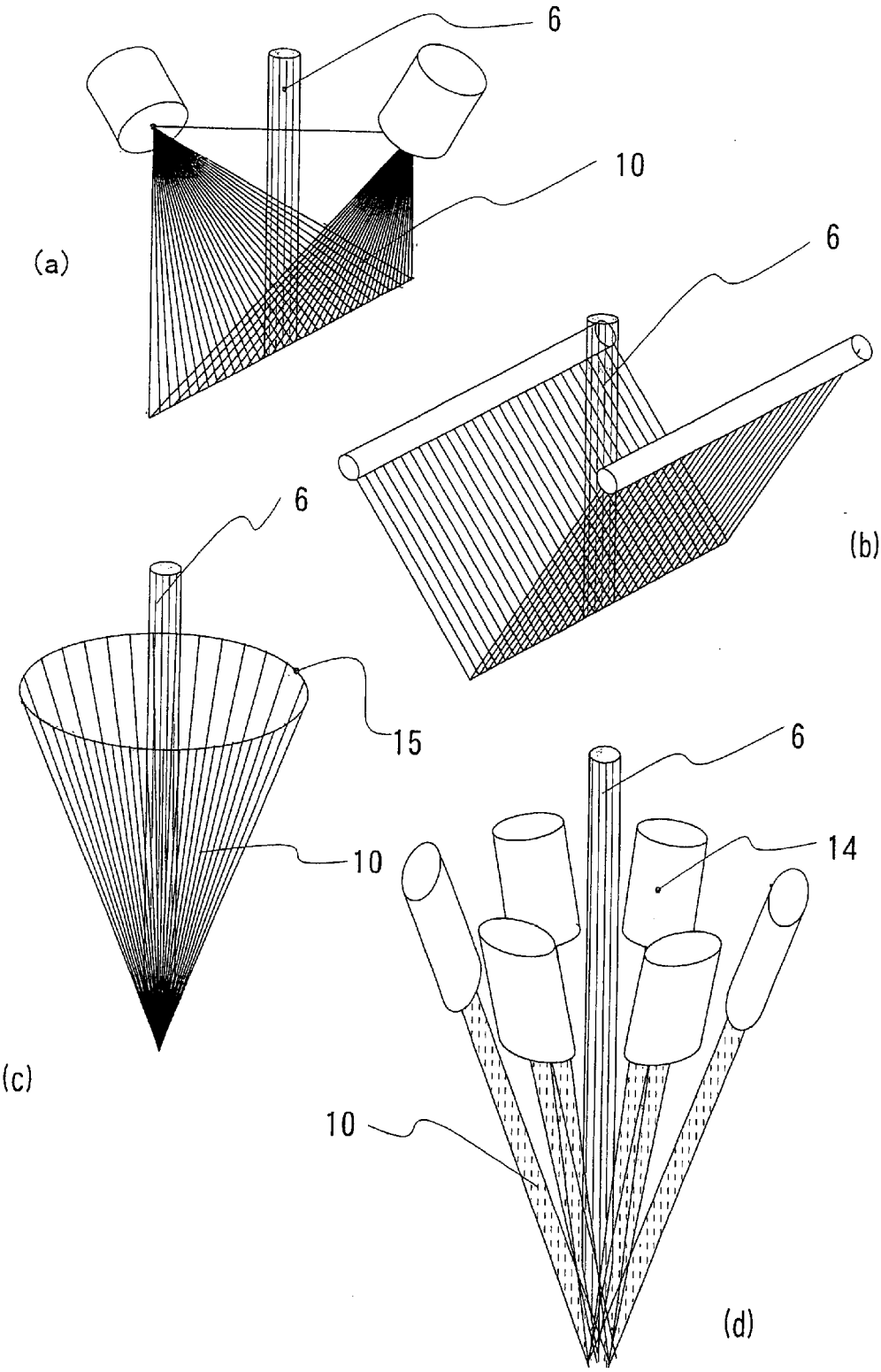
FIG. 11 is a view showing various liquid atomizing methods according to prior art.

The present invention is not limited to using the annular nozzle with the annular slit 5 as shown in FIG. 1. For example, the several nozzle parts 14 of the pencil jet type (FIG. 11(*d*)) may be disposed annularly with its discharging outlet oriented along the annular slit 5 shown in FIG. 1 so that each of the pencil jet type nozzle parts may discharge liquid jets in the form of a hyperboloid of one sheet agreeing with the flow lines 10. In this case, annularly disposed pencil jet type nozzle parts comprise the annular nozzle according to the present invention.

The apparatus with the annular nozzle 1 for preparing metal powder may efficiently produce finer and more spherical metal powder having a narrower particle size distribution than that of prior art. While this invention is not restricted to a particular consideration, the melt metal flow is dispersed not only by collision with the liquid jet similar to prior art but also by following mechanisms so as to prepare fine metal powder.

According to the present invention, the liquid jet of incompressible fluid has a high energy density, and the liquid jet is discharged in the form of a hyperboloid of one sheet to flow throughout stably without converging, and the hyperboloid of one sheet formed inside the exhaust pipe has a suddenly reduced pressure at the constricted part 11 or the lower part 32. Therefore when the melt metal flow 6 flows toward the constricted part 11, it flows down with drawn thereinto to be dispersed regularly and continuously by generally constant energy before passing through the constricted part to thereby produce fine melt metal drops.

Thusly dispersed melt metal drops may pass through the constricted part 11 and move to the lower part 32 to solidify into melt metal powder. According to the present invention, the melt metal drops before solidification are cooled relatively quietly without substantially crossing the face of the hyperboloid of one sheet to thereby be sphered by a surface tension. On the contrary, according to the prior art liquid atomizing methods the dispersed melt metal drops contact with each other near the focus of the liquid jet and are cooled rapidly and violently with contacting to and crossing the liquid jet, which is remarkably different from the present invention.

The present invention may be applied to any kinds of metal such as metal elements, metal compounds, metal alloys and intermetallic compounds. According to the present invention, metal powder having a desired character may be prepared by adjusted to the atomizing condition fitting to the property of the metal.

Preferable characters of the metal powder prepared by the present invention are described as followings . Except for noted particularly, following characters are described about metal powder atomized according to the present invention having a particle size of 1 mm and less separated by JISZ-8801.

① The metal powder prepared by the present invention preferably may have an apparent density ratio of 28% and more, especially 30% and more, and more especially 32%.

② The metal powder prepared by the present invention preferably may have a tap density ratio of 45% and more, especially 50% and more, and more especially 50% and more.

③ The metal powder preferably may have a median diameter of 50 $\mu$m and less, especially 35 $\mu$m and less, more especially 25 $\mu$m and less, and most especially 15 $\mu$m and less.

④ The metal powder having a median diameter of 25 $\mu$m and less preferably may include fine powder with a following particle size at a following concentration.

1) There preferably may exist fine powder having a particle size of 10 $\mu$m and less at a concentration of at least 20 weight %, especially 40 weight % and more, more especially 45 weight % and more.

2) There preferably may exist fine powder having a particle size of 5 $\mu$m and less at a concentration of at least 3 weight %, especially 10 weight % and more, and more especially 18 weight % and more.

⑤ The metal powder having a median diameter of 15 $\mu$m and less preferably may include fine powder having a following particle size at a following concentration.

1) There preferably may exist fine metal powder having a particle size of 10 $\mu$m and less at a concentration of at least 35 weight % and more, especially 45 weight % and more, more especially 50 weight % and more.

2) There preferably may exist fine metal powder having a particle size of 5 $\mu$m and less at a concentration of at least 10 weight % and more, especially 15 weight % and more, more especially 20 weight % and more.

3) There preferably may exist fine metal powder having a particle size of 1 $\mu$m and less at a concentration of at least 0.01 weight % and more, especially 0.05 weight % and more, more especially 0.1 weight % and more.

⑥ The metal powder prepared by the present invention preferably may have a geometric standard deviation of 2.5 and less, especially 2.3 and less, and more especially 2.2 and less. The geometric standard deviation can make estimation of the width of the particle size distribution.

⑦ The metal powder prepared by the present invention preferably may have a specific surface area of 4000 $cm^2/g$ and less, especially 3000 $cm^2/g$ and less, and more especially 2500 $cm^2/g$ and less.

EXAMPLE

The present invention is further described in accordance with examples. Following examples are best mode set forth by the inventors at application time, to which the present invention is not intended to be restricted.

The pressure variations are measured which is generated by the liquid jet discharged from various annular nozzles. The measurement of the pressure was carried out by one opening of a pipe for pressure measurement having a smaller sectional area by 20% and less than the cross sectional area of the constricted part inserted down from the top of the hyperboloid of one sheet along its central axis so that another opening of the pipe for pressure measurement is connected to a pressure meter.

FIG. 5 shows various graphs about the pressure variations inside the hyperboloid of one sheets by a swirling type annular nozzle $A_1$ with an exhaust pipe according to the present invention and a swirling type annular nozzle $B_1$ without the exhaust pipe according to prior art, and the conical by a conical jet type annular nozzle $C_1$ according to prior art.

This graph indicates that the present annular nozzle $A_1$ generates a remarkably large pressure reduction near the constricted part.

Figure 6:
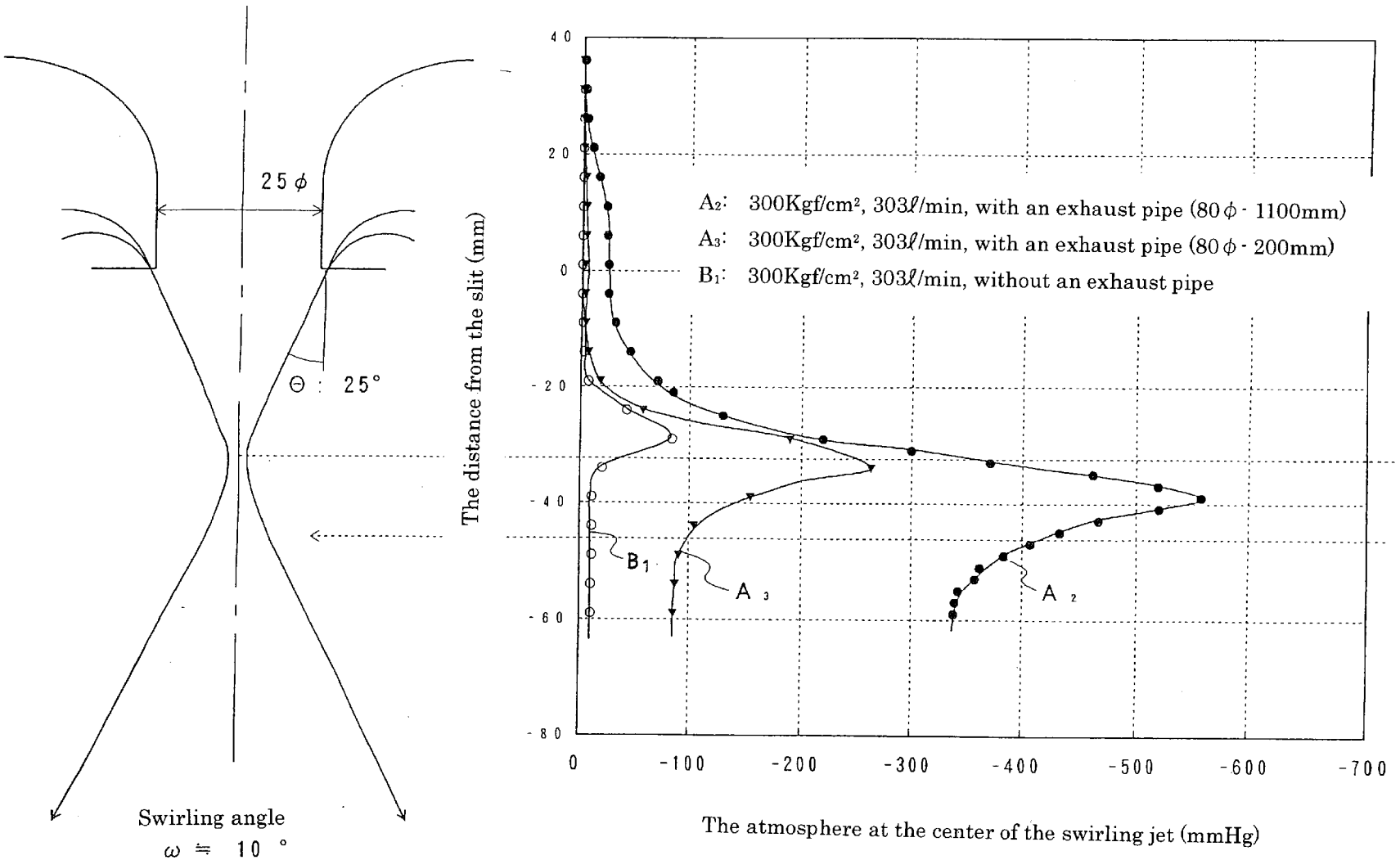

FIG. 6 shows various graphs about the pressure variations generated inside the hyperboloid of one sheets from a swirling type annular nozzle $A_2$ and $A_3$ with an exhaust pipe having various lengths according to the present invention and a swirling type annular nozzle $B_1$ without the exhaust pipe according to prior art.

This graph indicates that the annular nozzles $A_2$ or $A_3$ having an exhaust pipe has a much more reduced pressure near the constricted part of the hyperboloid of one sheet than that of the annular nozzle $B_1$ without an exhaust pipe. The annular nozzle $A_3$ having a longer exhaust pipe also has more reduced pressure than that of the annular nozzle $A_2$.

Figure 7:
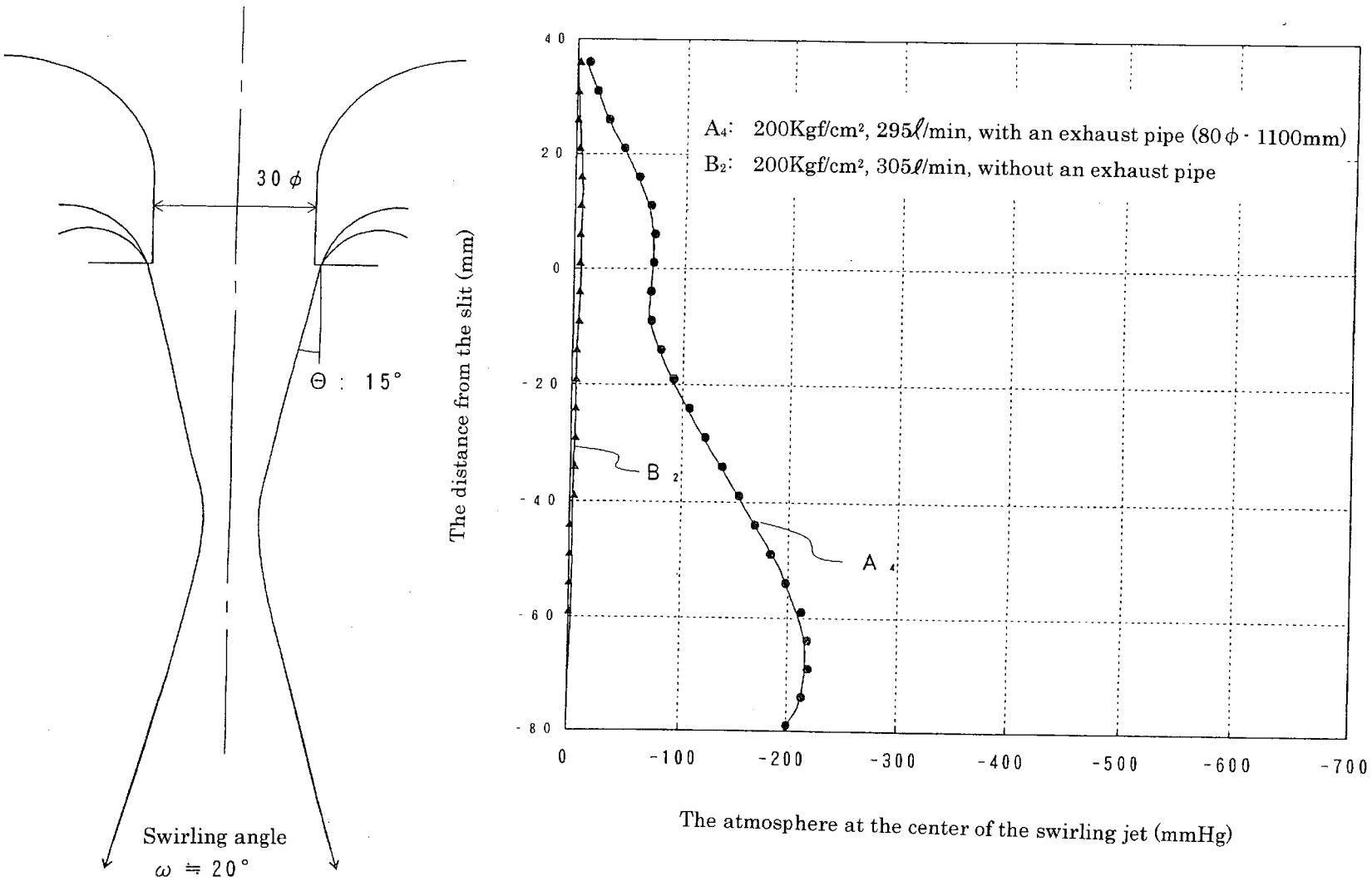

FIG. 7 shows various graphs showing pressure variation inside the hyperboloid of one sheets generated by the liquid jets from a swirling type annular nozzle $A_4$ according to the present invention as well as from a swirling type annular nozzle $B_2$ or $B_3$ without an exhaust pipe according to prior art.

This graph indicates that the exhaust pipe enables the pressure inside the hyperboloid of one sheet to be reduced.

Various kinds of metal powder of Cu, Cu-10% Sn alloy, Cr—Ni—Mo alloy and Fe—Si—Co alloy are prepared by using a present annular nozzle.

Analysis items described in table 1 were carried out on the metal powder having a particle size of 1 mm and less selected by JISZ 8801. Table 1 also shows the result. The concrete ways for these analysis are followings.

An apparent density was measured by ISO-3923.

A tap density was measured by ISO-3953.

An apparent density ratio was calculated by "apparent density"/"solid density"*100.

A tap density ratio was calculated by "tap density"/"solid density"* 100.

A median of particle size was measured by a laser diffraction method (volume %) using the MICRO TRAC. Another measurement by a sieve is added to the metal powder if including particle size of 250 μm and more.

A content of the fine powder having a particle size of 10 μm and less, 5 μm and less, or 1 μm and less occupied in the whole metal powder was measured by laser diffraction scattering (volume %).

A geometric standard deviation was calculated by "accumulation of metal powder of 50% diameter"/"accumulation of metal powder of 15.87%" in the obtained median of particle size.

A specific surface area was measured by a BET method according to a gaseous phase absorption method.

A content of oxygen was measured by a non-dispersive infrared absorption detector.

An yield is a percentage calculated from the weight of the metal powder having a particle size of 45 μm and less occupied in the weight of the metal powder having a particle size of 1 mm and less selected by JISZ 8801.

A scanning electron microscope made by Hitachi Seisakusyo Co. ltd. was used to take electron microscopic figures.

The results in table 1 and 2 support that the present invention may effect following characters when compared between same kinds of metal powder.

The apparent densities and the tap densities of the embodiments according to the present invention are higher than that of metal powder according to prior art. Also the relative apparent densities and the relative tap densities of the embodiments according to the present invention are higher than that of metal powder according to prior art. These results indicate that the metal powder according to the present invention has a more spherical shape than that of prior art.

The metal powder according to the present invention has a smaller median of particle size than that of prior art. This result indicates that the metal powder according to present invention is finer than that of prior art.

Metal powder according to the present invention includes much finer powder than that of prior art. In particular, it is remarkably different from prior art metal powder in that the present metal powder includes fine powder having a particle size of 1 μm and less appreciable by a laser diffraction scattering method.

The metal powder according to the present invention has a smaller geometric standard deviation than that of prior art, particularly in the case of the metal powder prepared by a prior art annular nozzle without an exhaust pipe. This result indicates that the metal powder according to the present invention has a narrower particle size distribution than that of prior art.

The oxygen content of the metal powder according to the present invention is lower than that of prior art. It is considered that this result attributes to be oxidation-proof because of smaller surface area of the present spherical metal powder.

The yield of the present invention is higher than that of prior art. It is considered that according to the present invention the melt metal flow is regularly and continuously dispersed by the liquid jet followed by that the dispersed melt metal drops may trend not to contact with each other before cooled quietly.

The figures by the electron microscope apparently show that the present metal powder has a sherical particle shape having an eliminated edge.

Figure 8:
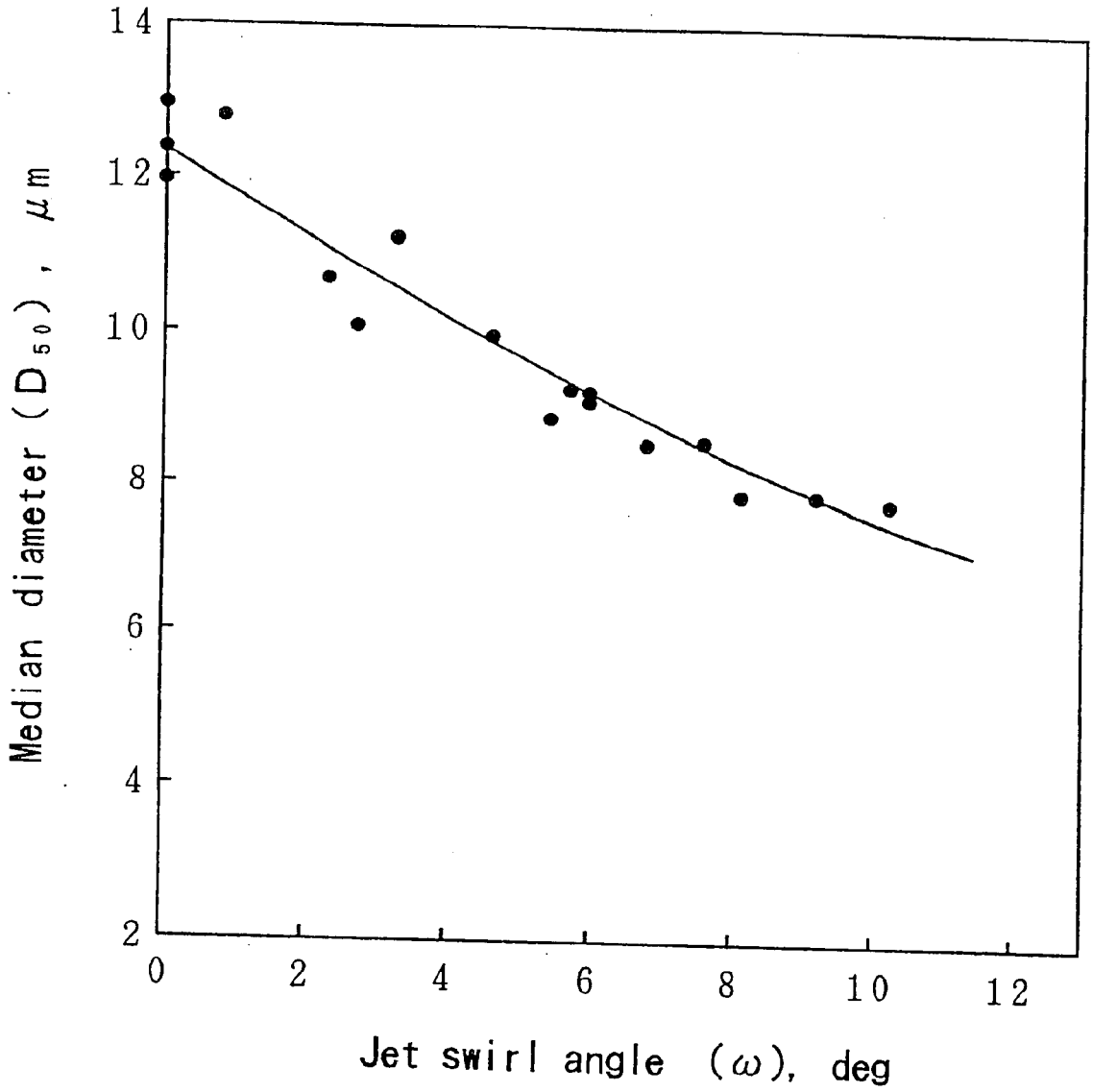
FIG. 8 is a graph showing a relation between the swirling angle of the liquid jet and the median of the size of the obtained metal powder.
Figure 9:
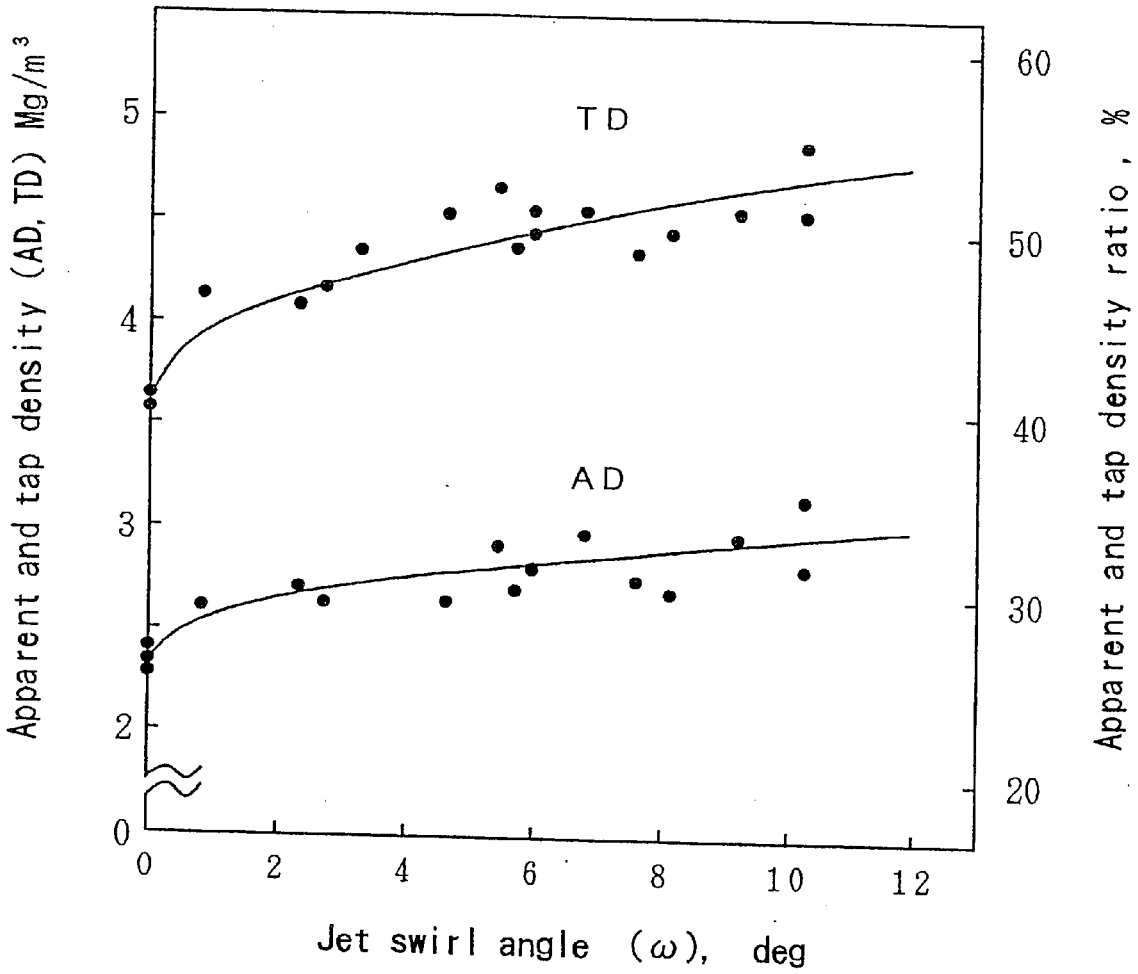
FIG. 9 is a graph showing a relation between the size of the swirling angle of the liquid jet and the apparent or the tap density.
Figure 10:
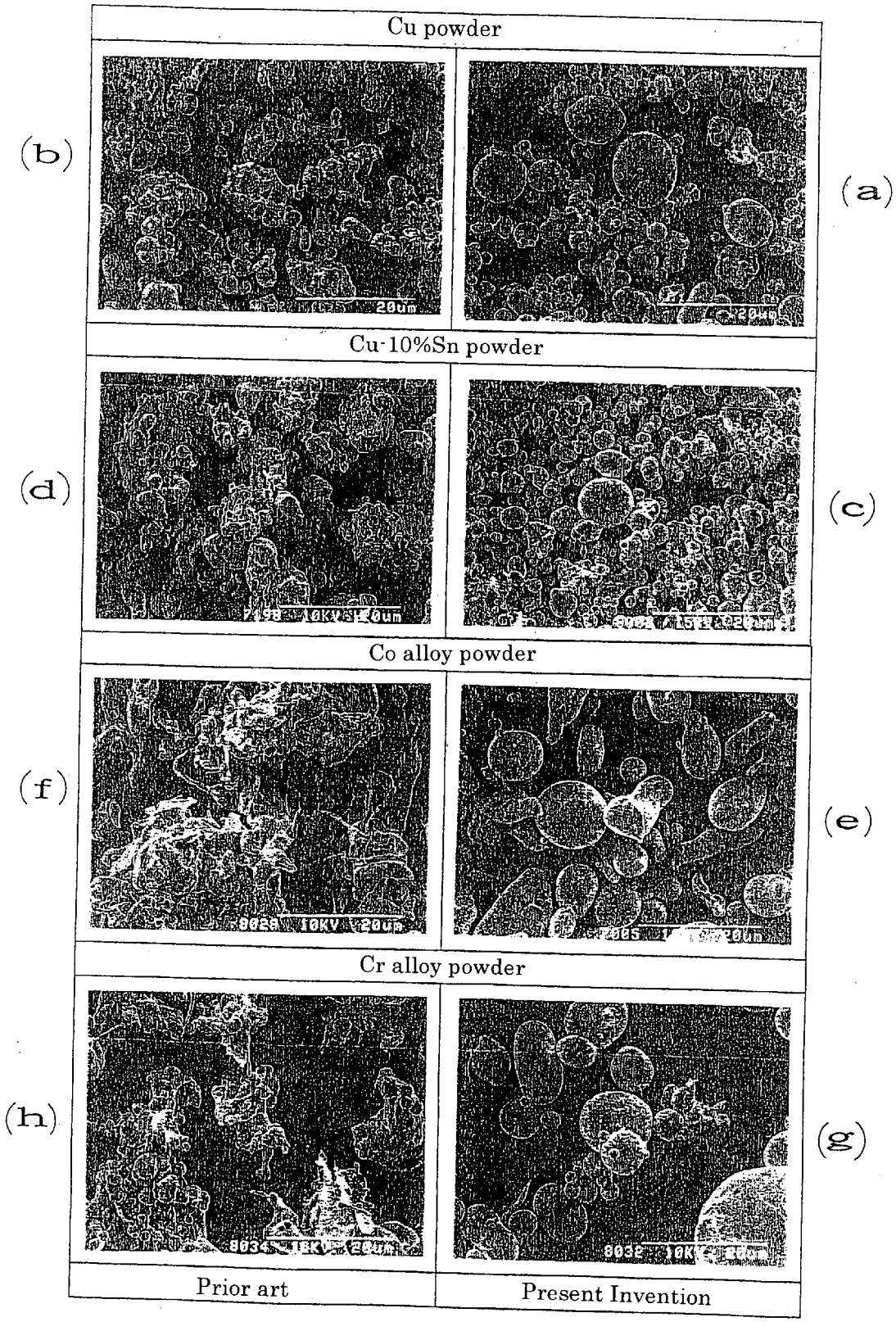
FIG. 10 is a view of metal powder according to the present invention and prior art, which are magnified by an electron microscope.

In addition, various types of Cu-10% Sn metal alloy powder ware prepared by the liquid jet having various swirling angle ω discharged from the present annular nozzle at a pressure of 850 Kgf/cm$^2$ and 135 l/min in order to investigate a relationship between the swirling angle of the liquid jet and the median of the particle size, and a relationship between the swirling angle and the apparent or the tap density. These results are described in FIGS. 8 and 9.

These results indicates that the larger the swirling angle is, the finer and the more sherical the metal powder is.

TABLE 1

| | metal powder | | | | | | | | | |
|---|---|---|---|---|---|---|---|---|---|---|
| | Cu | | | | | Cu - 10% Sn alloy | | | | |
| | embodiment No. or comparison No. | | | | | | | | | |
| | emb. 1 | emb. 2 | comp. 1 | comp. 2 | comp. 3 | emb. 3 | emb. 4 | comp. 4 | comp. 5 | comp. 6 |
| Atomizing condition | | | | | | | | | | |
| pressure of the injected cooling liquid (Kgf/cm$^2$) | 80 | 400 | 85 | 375 | 80 | 205 | 830 | 100 | 935 | 150 |
| speed of the liquid jet (m/sec) | 125 | 280 | 129 | 271 | 125 | 200 | 403 | 140 | 428 | 300 |
| pressure of the constricted part (mmHg) | −320 | −585 | — | — | −50 | −212 | −670 | — | — | −60 |
| swirling angle ω (°) | 14.1 | 5.44 | 0 | 0 | 9.8 | 4.1 | 5.4 | 0 | 0 | 14.7 |
| descending angle θ (°) | 35 | 25 | 33 | 25 | 17 | 38.5 | 22 | 15.4 | 25 | 17 |
| volume of the cooling liquid/volume of the melt metal | 10 | 10 | 10 | 10 | 10 | 20 | 20 | 20 | 20 | 20 |
| with or without the exhaust pipe | with | with | with | with | without | with | with | without | with | without |
| Analyzed result of the obtained metal powder | | | | | | | | | | |
| apparent density (g/cm$^3$) | 4.5 | 3.5 | 3.4 | 2.8 | 4.2 | 3.66 | 2.91 | 3.30 | 2.49 | 3.6 |
| tap density (g/cm$^3$) | 5.8 | 5.3 | 4.9 | 4.5 | 5.5 | 4.98 | 4.72 | 4.21 | 3.62 | 5.1 |
| apparent density ratio (%) | 50.6 | 39.0 | 38.2 | 31.5 | 47.2 | 41.1 | 32.7 | 37.1 | 28.0 | 40.0 |
| tap density ratio (%) | 65.0 | 59.6 | 55.1 | 50.6 | 61.5 | 46.1 | 53.1 | 47.3 | 40.7 | 57.3 |
| median diameter (μm) | 36.4 | 15.2 | 80.5 | 25.4 | 130 | 20.4 | 8.86 | 73.5 | 10.4 | 75.4 |
| percentage content of the fine metal powder occupied in the metal powder (%) | | | | | | | | | | |
| 10 μm and less | — | 46 | — | 18 | — | — | 57 | — | 45 | — |
| 5 μm and less | — | 19 | — | 5 | — | — | 26 | — | 17 | — |
| 1 μm and less | — | 0.11 | — | 0 | — | — | 0.39 | — | 0 | — |
| geometric standard deviation | 1.99 | 2.11 | 2.65 | 2.79 | 3.21 | 2.00 | 2.15 | 2.97 | 2.24 | 3.1 |
| specific surface area (cm$^2$/g) | 370 | 1600 | 670 | 2200 | 420 | 1120 | 1900 | 560 | 2600 | 520 |
| content of oxigen (%) | 0.15 | 0.11 | 0.12 | 0.25 | 0.32 | 0.07 | 0.09 | 0.09 | 0.16 | 0.27 |
| yield (%) | 58.6 | 95.6 | 37.3 | 78.2 | 30.1 | 69.8 | 98.3 | 42.1 | 87.9 | 20.5 |
| number of the figure of the powder magnified by electron microscope | — | (a) | — | (b) | — | — | (c) | — | (d) | — |

TABLE 2

| | metal powder | | | | | | | | | |
|---|---|---|---|---|---|---|---|---|---|---|
| | Cr—Ni—Mo alloy | | | | | Fe—Si—Co alloy | | | | |
| | embodiment No. or comparison No. | | | | | | | | | |
| | emb. 5 | emb. 6 | comp. 7 | comp. 8 | comp. 9 | emb. 7 | emb. 8 | comp. 10 | comp. 11 | comp. 12 |
| Atomizing condition | | | | | | | | | | |
| pressure of the injected cooling liquid (Kgf/cm$^2$) | 500 | 720 | 255 | 720 | 200 | 855 | 720 | 800 | 200 | 200 |
| speed of the liquid jet (m/sec) | 313 | 376 | 224 | 376 | 198 | 409 | 376 | 396 | 198 | 198 |
| pressure of the constricted part (mmHg) | −610 | −620 | — | — | −70 | −594 | −580 | — | — | −70 |
| swirling angle ω (°) | 10.2 | 3.7 | 0 | 0 | 9.0 | 8.13 | 7.5 | 0 | 0 | 7.7 |
| descending angle θ (°) | 25 | 15 | 25 | 9 | 15 | 35 | 20 | 25 | 18 | 16 |
| volume of the cooling liquid/volume of the melt metal | 40 | 40 | 40 | 40 | 40 | 30 | 30 | 30 | 30 | 30 |
| with or without the exhaust pipe | with | with | with | without | without | with | with | with | without | without |
| Analyzed result of the obtained metal powder | | | | | | | | | | |
| apparent density (g/cm$^3$) | 2.79 | 2.53 | 2.34 | 1.77 | 2.5 | 1.69 | 1.82 | 1.19 | 1.50 | 1.8 |
| tap density (g/cm$^3$) | 4.88 | 4.73 | 3.71 | 3.28 | 4.7 | 2.29 | 3.22 | 2.17 | 2.50 | 2.8 |
| apparent density ratio (%) | 36.7 | 33.3 | 30.8 | 23.3 | 32.9 | 33.8 | 36.3 | 23.8 | 30.0 | 36.0 |
| tap density ratio (%) | 64.2 | 62.3 | 48.8 | 43.2 | 61.8 | 58.8 | 64.5 | 43.4 | 50.1 | 56.0 |
| median diameter (μm) | 15.5 | 12.3 | 57.4 | 17.9 | 75.2 | 7.49 | 8.89 | 12.3 | 27.9 | 60.5 |
| percentage content of the fine metal powder occupied in the metal powder (%) | | | | | | | | | | |
| 10 μm and less | 28 | 47 | — | 23 | — | 62 | 52 | 38 | — | — |
| 5 μm and less | 10 | 25 | — | 7 | — | 26 | 20 | 15 | — | — |

TABLE 2-continued

| | metal powder | | | | | | | | | |
|---|---|---|---|---|---|---|---|---|---|---|
| | Cr—Ni—Mo alloy | | | | | Fe—Si—Co alloy | | | | |
| | embodiment No. or comparison No. | | | | | | | | | |
| | emb. 5 | emb. 6 | comp. 7 | comp. 8 | comp. 9 | emb. 7 | emb. 8 | comp. 10 | comp. 11 | comp. 12 |
| 1 μm and less | 0.02 | 0.15 | — | 0 | — | 0.42 | 0.13 | 0 | — | — |
| geometric standard deviation | 2.24 | 2.07 | 2.79 | 2.57 | 2.8 | 2.19 | 2.07 | 2.79 | 2.87 | 2.9 |
| specific surface area ($cm^2/g$) | 1700 | 2100 | 590 | 2500 | 320 | 3700 | 3400 | 3500 | 1100 | 450 |
| content of oxigen (%) | 0.67 | 0.78 | 0.51 | 1.08 | 1.51 | 0.18 | 0.17 | 0.17 | 0.09 | 0.12 |
| yield (%) | 86.7 | 95.1 | 45.2 | 82.3 | 36.2 | 94.5 | 90.3 | 84.1 | 44.1 | 33.2 |
| number of the figure of the powder magnified by electron microscope | (e) | — | — | (f) | — | (g) | — | (h) | — | — |

What is claimed is:

1. An apparatus for preparing metal powder, the apparatus including an annular nozzle comprising:

a body having a hole for passing a flow of molten metal, a swirling room formed in the body for swirling a cooling liquid around the hole, and an annular slit between the swirling room and the hole for discharging swirled cooling liquid contained in the swirling room toward the flow of molten metal flowing through the hole, and an exhaust pipe extending downwardly from a lower surface of the annular nozzle with the hole having a central axis consonant to that of the exhaust pipe, an end of the exhaust pipe opposed to an end of the exhaust pipe extending downwardly from the lower surface being an open end, wherein the exhaust pipe has a length of "L" and an inner diameter of "R" and the annular slit has a diameter "r", and wherein the exhaust pipe has the length "L" being 3–100 r and the inner diameter "R" being 1.5–5 r, and wherein the flow of molten metal passes through the hole and into the exhaust pipe to be surrounded by the discharged cooling liquid in the form of a hyperboloid of one sheet inside the exhaust pipe to be exhausted, and wherein the hyperboloid of one sheet has a pressure reduced by 50–750 mmHg at a point forming a constricted part inside the exhaust pipe.

2. The apparatus for preparing metal powder of claim 1, wherein the exhaust pipe has a longitudinal section going through the central axis of the exhaust pipe, wherein the longitudinal section has one slant part extending downwardly to be distant from the central axis to thereby eliminate or prevent the collision of the cooling liquid with the inner wall of the exhaust pipe.

3. The apparatus for preparing metal powder of claim 2, wherein a rectification body with a trunk is disposed in the exhaust pipe along the inside of the lower part of the hyperboloid of one sheet formed inside the exhaust pipe, wherein the cross sectional area of the trunk is larger than that of the constricted part of the hyperboloid of one sheet to thereby prevent the cooling liquid passing through the exhaust pipe from becoming turbulent.

4. The apparatus for preparing metal powder of claim 1, wherein the exhaust pipe has a longitudinal section going through the central axis of the exhaust pipe, and wherein the longitudinal section has one slant part extending downwardly to be distant from the central axis for eliminating the collision of the cooling liquid and another slant part extending downwardly to approach the central axis.

5. A method for preparing metal powder comprising, providing an apparatus with an annular nozzle, the annular nozzle having a hole for passing a flow of molten metal, a swirling room which surrounds the hole, and an annular slit about the hole which provides communication between the swirling room and the hole, and an exhaust pipe extending downwardly from a lower surface of the annular nozzle with the hole having a central axis consonant to that of the exhaust pipe, and wherein the exhaust pipe has a length of "L" and an inner diameter of "R" and the annular slit has a diameter "r" and wherein the length "L" of the exhaust pipe is 3–100 r and the inner diameter "R" is 1.5–5 r, flowing the molten metal through the hole and into the exhaust pipe while swirling a cooling liquid in the swirling room and discharging the swirled cooling liquid from the annular slit toward the flow of molten metal passing through the hole such that the discharged cooling liquid surrounds the flow of molten metal inside the exhaust pipe in the form of a hyperboloid of one sheet, wherein a point of the hyperboloid of one sheet has a pressure reduced by 50–750 mmHg to form a constricted part.

6. The method of claim 5, wherein the cooling liquid is discharged in the direction having a swirling angle ω of $1° \leqq \omega \leqq 20°$ and a descending angle θ of $5° \leqq \theta \leqq 60°$.

7. The method of claim 5 wherein the resultant metal power has a median of particle size of 50 μm and less, a geometric standard deviation of 2.5 and less, and a spherical shape.

8. An annular nozzle for disposing in an apparatus for preparing metal powder, the annular nozzle comprising:

a body having a hole for passing a flow of molten metal, a swirling room formed in the body for swirling a cooling liquid around the hole, and an annular slit between the swirling room and the hole for discharging swirled cooling liquid contained in the swirling room toward the flow of molten metal flowing through the hole, and an exhaust pipe extending downwardly from a lower surface of the annular nozzle with the hole having a central axis consonant to that of the exhaust pipe, an end of the exhaust pipe opposed to an end of the exhaust pipe extending downwardly from the lower surface being an open end, wherein the exhaust pipe has a length of "L" and an inner diameter of "R" and the annular slit has a diameter "r", and wherein the exhaust pipe has the length "L" being 3–100 r and the inner diameter "R" being 1.5–5 r, and wherein the flow of molten metal passes through the hole and into the exhaust pipe to be surrounded by the discharged cooling liquid in the form of a hyperboloid of one sheet inside the exhaust pipe to be exhausted, and wherein the hyperboloid of one sheet has a pressure reduced by 50–750 mmHg at a point forming a constricted part inside the exhaust pipe.

9. The annular nozzle of claim 8, wherein the exhaust pipe has a longitudinal section going through the central axis of the exhaust pipe, wherein the longitudinal section has one slant part extending downwardly to be distant from the central axis to thereby eliminate or prevent the collision of the cooling liquid with the inner wall of the exhaust pipe.

10. The annular nozzle of claim 9, wherein a rectification body with a trunk is disposed in the exhaust pipe along the inside of the lower part of the hyperboloid of one sheet formed inside the exhaust pipe, wherein the cross sectional area of the trunk is larger than that of the constricted part of the hyperboloid of one sheet to thereby prevent the cooling liquid passing through the exhaust pipe from becoming turbulent.

11. The annular nozzle of claim 8, wherein the exhaust pipe has a longitudinal section going through the central axis of the exhaust pipe, and wherein the longitudinal section has one slant part extending downwardly to be distant from the central axis for eliminating the collision of the cooling liquid and another slant part extending downwardly to approach the central axis.

* * * * *